United States Patent [19]

Fleischer

[11] 4,150,283

[45] Apr. 17, 1979

[54] PLUG-IN COUNTER WITH COST REDUCTION

[75] Inventor: Donald W. Fleischer, Wethersfield, Conn.

[73] Assignee: Veeder Industries Inc., Hartford, Conn.

[21] Appl. No.: 875,199

[22] Filed: Feb. 6, 1978

[51] Int. Cl.[2] ..... G06M 3/12; G06B 27/06

[52] U.S. Cl. ..... 235/92 CT; 235/92 C; 235/92 SB; 235/92 AC; 235/92 R

[58] Field of Search ..... 235/92 SB, 92 CT, 92 AC, 235/92 C, 92 PD; 355/14

[56] References Cited

U.S. PATENT DOCUMENTS

| | | | |
|---|---|---|---|
| 3,120,602 | 2/1964 | Lagarde | 235/92 CT |
| 3,427,441 | 2/1969 | Swords | 235/92 SB |
| 3,551,652 | 12/1970 | Faude | 235/92 CT |
| 3,670,924 | 6/1972 | Asper | 235/92 CT |
| 3,719,805 | 3/1973 | Takeotano | 235/92 CT |
| 3,779,357 | 12/1973 | Haller et al. | 235/92 FL |
| 3,872,282 | 3/1975 | Long | 235/92 CT |
| 3,997,873 | 12/1976 | Thorton | 235/92 SB |

*Primary Examiner*—Joseph M. Thesz

*Attorney, Agent, or Firm*—Prutzman, Kalb, Chilton & Alix

[57] ABSTRACT

A plug-in counter system for recording the use of an associated business machine and having a plug-in counter unit for each user and a receptacle unit for individually inserting each counter unit therein, the receptacle unit and each counter unit having magnetic couplings for magnetically coupling an electromagnet of the receptacle unit to an inserted counter unit for indexing the counter unit with the electromagnet.

10 Claims, 5 Drawing Figures

158
154
150
156
161
162
162
164
164
166
167
160
85
70
68
72
76
78
16
22

PLUG-IN COUNTER WITH COST REDUCTION

BRIEF SUMMARY OF THE INVENTION

The present invention relates to plug-in counter systems of the type disclosed in U.S. Pat. No. 3,436,530 of R. Faude et al. and entitled "Control Device", and having a plug-in counter receptacle and one or more plug-in counters adapted to be individually inserted into the receptacle for activating a machine such as a duplicating machine with which the receptacle is associated, and for recording the usage of the activated machine.

It is a principle object of the present invention to provide a plug-in counter system of the type described having a new and economical electromagnetic actuating mechanism for electromagnetically actuating the inserted plug-in counter for recording the usage of the associated machine.

It is another object of the present invention to provide a new and improved plug-in counter system having a plurality of plug-in counters of economical design and having notable utility in recording the usage of a duplicating or other business machine by each of a plurality of authorized operators.

It is a further object of the present invention to reduce the cost of commercially available plug-in counter systems. Included in this object is the provision of a new and improved low-cost plug-in counter which can be substituted for commercially available plug-in counters.

It is another object of the present invention to provide a new and improved modified plug-in counter system having a modified plug-in counter receptacle which is fully compatible with plug-in counters of existing commercial systems as well as modified low-cost plug-in counters of the modified system.

It is a further object of the present invention to provide a new and improved plug-in counter system which permits the plug-in counter to be constructed more economically, with less weight and, if desired, more compactly.

Other objects will be in part obvious and in part pointed out more in detail hereinafter.

A better understanding of the objects, advantages, features, properties and relations of the invention will be obtained from the following detailed description and accompanying drawings which set forth illustrative embodiments and are indicative of the various ways in which the principles of the invention are employed.

DESCRIPTION OF THE PREFERRED EMBODIMENT

Figure 1:
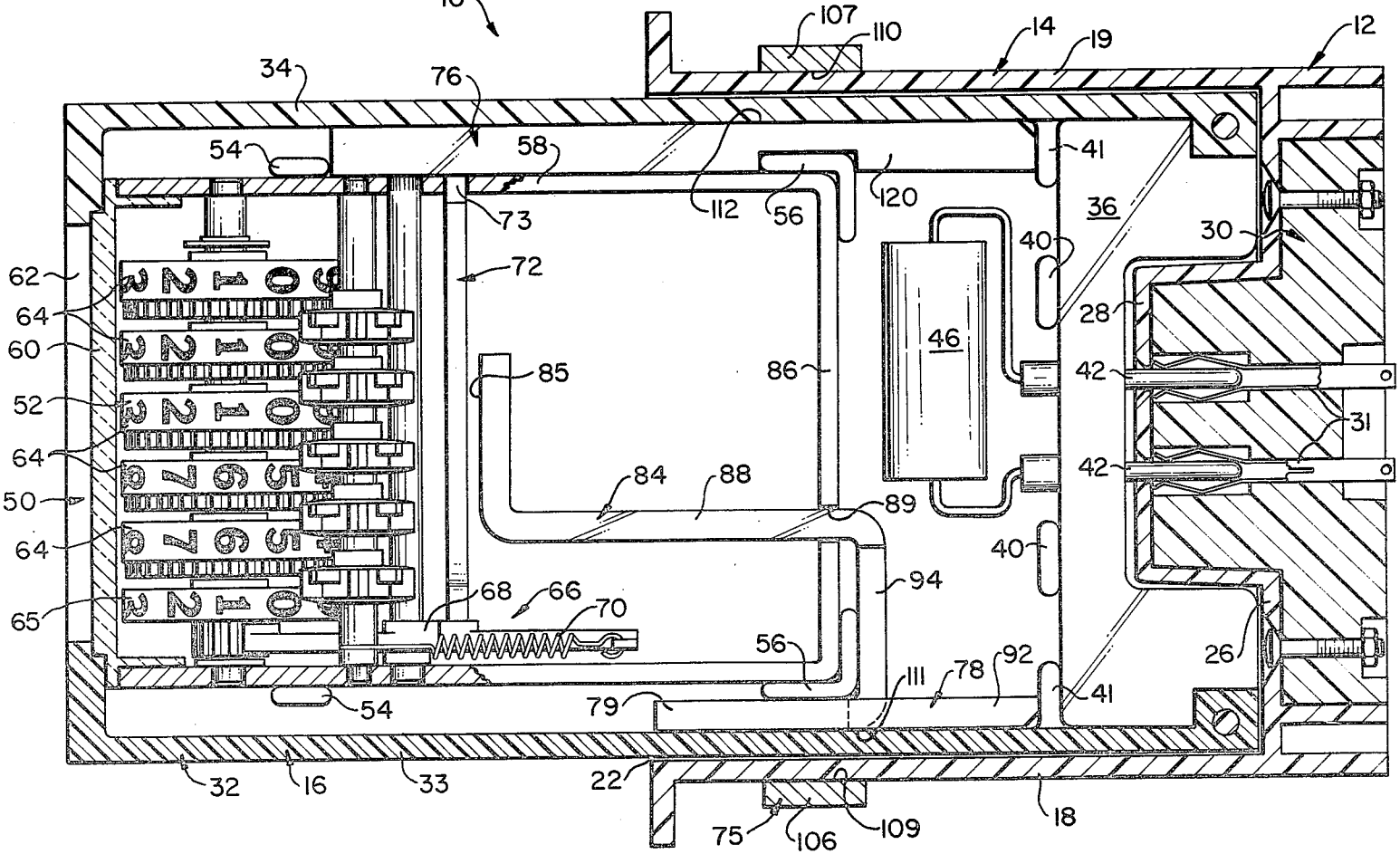
FIG. 1 is a partial top plan section view, partly broken away and partly in section, of a plug-in counter and receptacle assembly incorporating the present invention.
Figure 2:
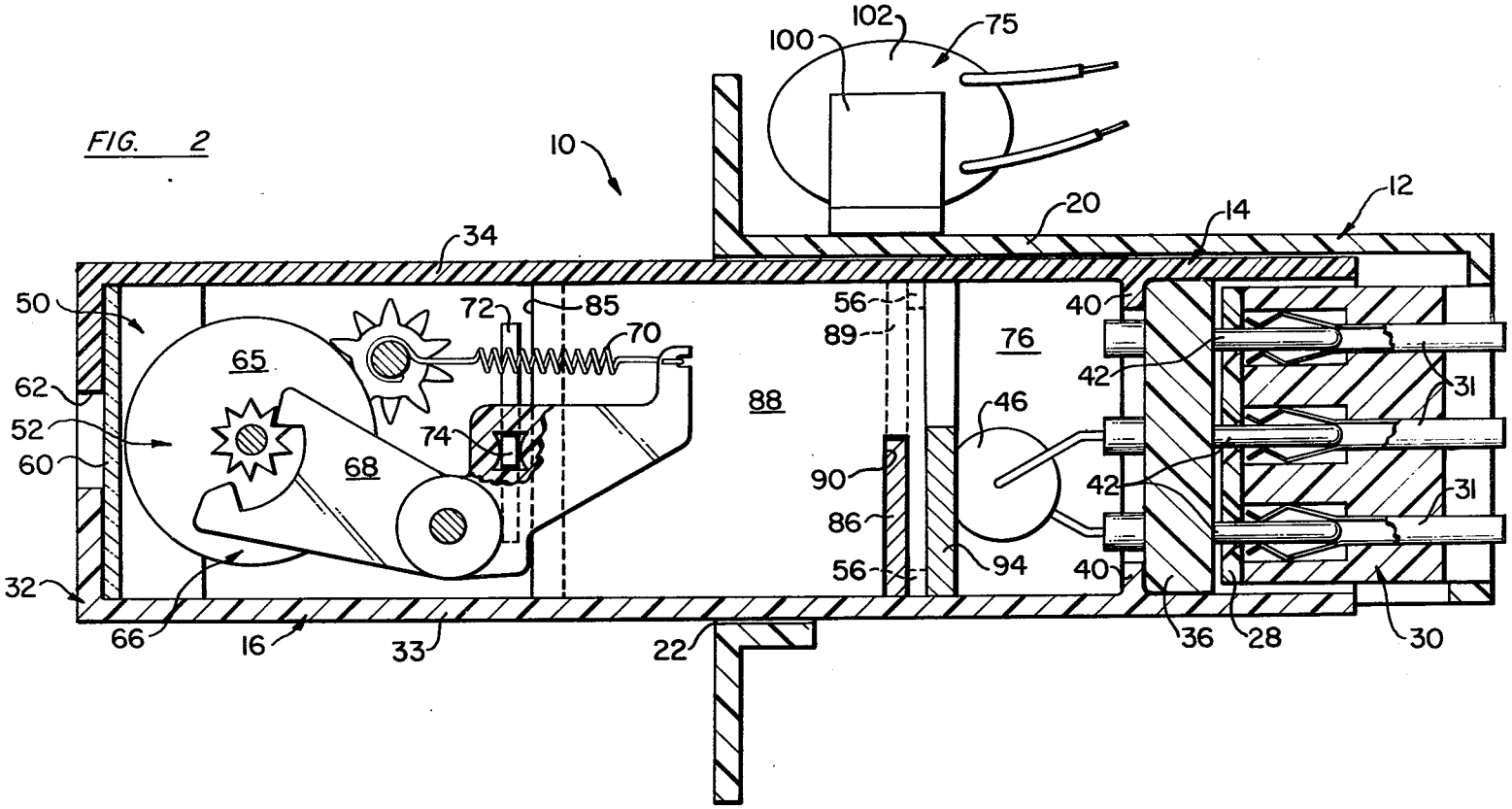
FIG. 2 is a partial side elevation section view, partly broken away and partly in section, of the assembly of FIG. 1.
Figure 3:
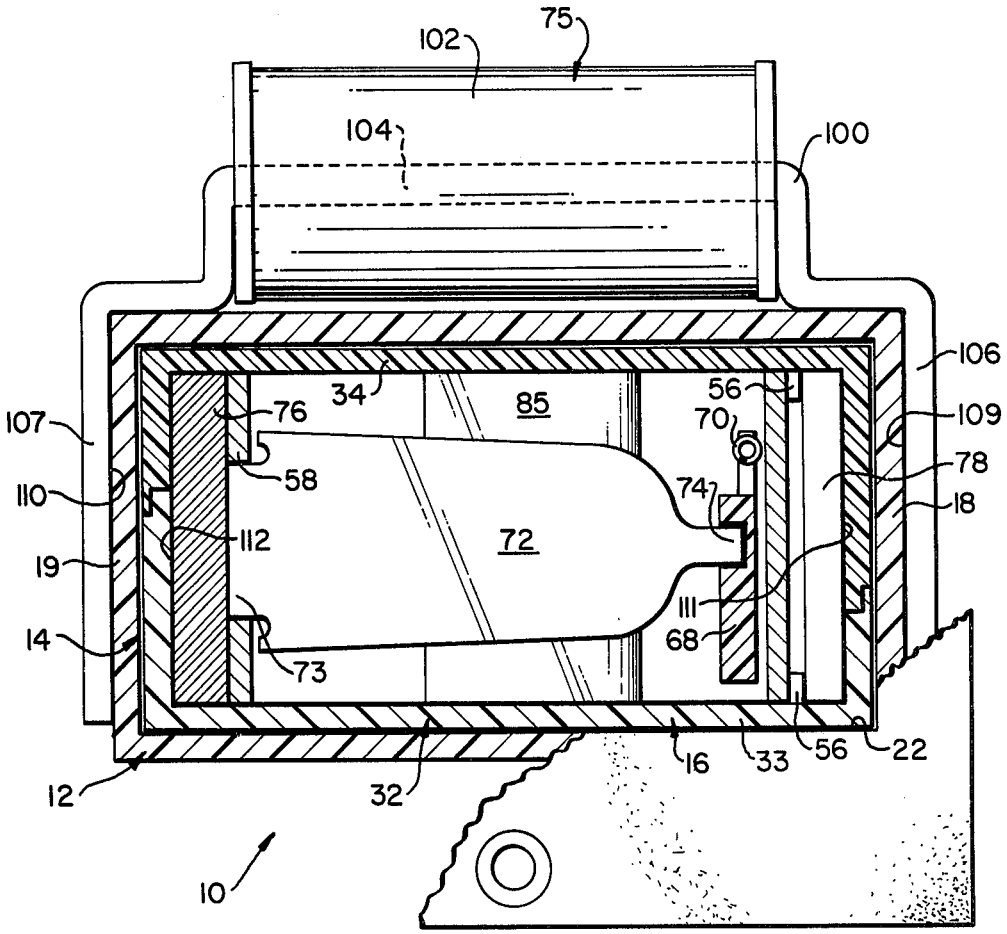
FIG. 3 is a front elevation view, partly broken away and partly in section, of the assembly of FIG. 1.

Referring now to the drawings in detail, wherein like numerals designate like parts throughout the several figures, and referring particularly to FIGS. 1–3, an embodiment 10 of a counter and receptacle assembly of the present invention is shown having a receptacle unit 12 with a box-like receptacle 14 for receiving a plug-in counter unit 16. The receptacle unit 12 and the plug-in counter unit 16 shown are similar to commercially available units excepting as described hereinafter.

The box-like receptacle 14 has parallel sidewalls 18, 19, a top wall 20, and a front rectangular opening 22 for inserting the plug-in counter unit 16 into the receptacle 14 to an operational position thereof shown in FIGS. 1–3. A rear end wall 26 of the receptacle 14 is formed with a central rectangular projection 28 and a generally T-shaped female electrical receptacle 30 is mounted within a rear cavity of the receptacle unit formed in part by the rear wall 26. The female electrical receptacle 30 is shown having six female electrical connectors 31, in two vertical rows of three electrical connectors each.

A plurality of, for example, ten or more plug-in counter units 16 may be employed with the receptacle unit 12 and be individually inserted into the receptacle 14 to an operational position thereof shown in FIGS. 1–3. However, only one such plug-in counter unit 16 is shown in the drawings for convenience. The plug-in counter unit 16 has an outer box-like case 32 with identical molded plastic casing halves 33, 34 which interfit to form the case. A separate generally U-shaped male electrical connector 36 is formed to be readily inserted to interfit between the two casing halves 33, 34 and held in position by oppositely extending integral projections 40, 41 of the casing halves 33, 34. The male connector 36 has six male connector pins, two rows of three pins each, positioned for being inserted into the female connectors 31 when the plug-in counter unit 16 is inserted into the receptacle 14. For that purpose, the forward rear wall projection 28 is provided with apertures aligned with the female connectors 31 for receiving the male connector pins 42. A suitable resistor or other electrical circuit 46 is connected between a predetermined pair of the male connector pins 42 to provide security means for verifying that the plug-in counter unit 16 is an authorized unit for the receptacle unit installation.

A counter subassembly 50 having a conventional six-wheel counter 52 is mounted within the case 32 and held in place by opposed upstanding side projections 54 and corner projections 56 of the casing halves 33, 34 at the sides and rear corners of a U-shaped frame 58 of the counter subassembly 50. A front plastic window 60 of the counter subassembly 50 is mounted between the ends of the U-shaped frame 58 for viewing the counter 52 through a front end opening 62 of the case 32. The counter 52 is of conventional design and employs conventional decade wheels 64,65 each having the usual 0–9 indicia sequence on its outer rim.

A counter indexing mechanism 66 of the subassembly 50 having a pivotal verge 68 spring actuated in one pivotal direction by a tension spring 70, is provided for indexing the counter 52. A pivotal clapper or armature 72 adapted to be magnetically actuated as hereinafter described has one end 73 pivotally mounted on the U-shaped frame 58 and its other end 74 operatively connected to the verge 68. The clapper 72, then magnetically actuated, pivots the verge 68 in the clockwise direction as viewed in FIG. 2 against the bias of the tension spring 70 to index the counter 52 one-half count. When the clapper 72 is released, the tension spring 70 pivots the verge 68 in the opposite direction, in the counterclockwise direction as viewed in FIG. 2, to index the counter 52 the remaining one-half count.

In similar conventional commercially available plug-in counter units, a suitable electromagnetic (not shown) is mounted in the rear end of the U-shaped frame 58 for magnetically actuating the clapper 72. The leads (not shown) of the conventional electromagnet are connected to predetermined male connector pins 42 for connecting the electromagnet to external circuitry for energizing the electromagnet and thereby index the counter 52.

In accordance with the present invention, an external electromagnet 75 is provided as part of the receptacle unit 12 in place of the prior employment of an electromagnet (not shown) instead of internally in each of the plug-in counter units 16, and whereby a single external electromagnet 75 is used in the plug-in counter system in place of, for example, ten or more internal electromagnets. As a result, the total cost of the system is substantially less. Also, the cost and weight of each plug-in counter unit 16 is significantly less.

Further in accordance with the present invention, each plug-in counter unit 16 is formed with a frame 58 of non-magnetic material such as aluminum in place of the soft iron frame previously employed. Also, a pair of soft iron flux conductor plates 76, 78 are formed so as to be readily mounted between the casing halves 33, 34 in the positions shown. More particularly, the flux conductor plate 76 is mounted between one leg of the U-shaped frame 58 and the adjacent sidewall of the case 32 and extends between the integral projections 54, 56 and 41 of the casing halves 33, 34. The flux conductor plate 76 is thereby mounted contiguous and provides a low reluctance path to the outer pivot end 73 of the clapper 72.

The flux conductor plate 78 is formed with base portion 79 in engagement with the opposite sidewall of the case 32 and held in place by the projections 41, 56 of the opposed casing halves 33, 34. The flux conductor plate 78 is further formed with a generally S-shaped portions 84 having an outer end with a pole face 85 adjacent to and spaced from the clapper 72 for magnetically actuating the clapper 72 and thereby index the counter 52 as described. As seen in FIG. 2, the base 86 of the counter frame 58 and the intermediate leg 88 of the S-shaped portion 84 have cooperating slots 89, 90 respectively for interlocking the flux conductor plate 78 and frame 58 and thereby securely and accurately position the pole face 85 relative to the clapper 72. Also, a rear extension 92 of the base portion 79 of the flux conductor plate 78 is cut-out from the adjacent leg 94 of the S-shaped portion 84 so that the entire flux conductor 78 may be formed from a single metal plate.

The electromagnet 75 has a core plate 100 and an operating coil 102 encircling a central raised portion 104 of the core plate 100. The core plate 100 is formed to support the electromagnet on the top wall 20 of the receptacle 14 and to have depending parallel end poles 106, 107 along the opposite sidewalls 18, 19 of the receptacle 14. Therefore, the depending end poles 106, 107 have oppositely inwardly facing parallel faces 109, 110 adjacent and directly opposed to the opposite outwardly facing parallel faces 111, 112 of the flux conductors 76, 78 respectively. The opposed pairs of adjacent faces 109, 111 and 110, 112 thereby provide magnetic coupling faces for magnetically coupling the external electromagnet 75 to the internal flux conductors 76, 78 of the inserted plug-in counter unit 16. Accordingly, by energizing the electromagnet operating coil 102, the clapper 72 is magnetically actuated to index the counter 52. Also, it can be seen that the two flux conductor plates 76, 78 are mounted in magnetic series association with the clapper 72 to provide a relatively low reluctance magnetic path for coupling the external electromagnet 75 for actuating the internal clapper 72 of an inserted plug-in counter unit 16.

The flux conductor plates 76, 78 have rear extensions 120, 92 respectively which extend rearwardly of the electromagnet end poles 106, 107 respectively when the plug-in counter 16 is fully inserted to its operational position shown in FIGS. 1–3. A plug-in counter unit 16 is thereby adapted to be operatively coupled to the electromagnet 75 before the plug-in counter unit 16 makes electrical connection with the female connectors 31. Accordingly, the control function provided by the security circuit 46 of the plug-in counter unit is not effective until after the electromagnet 75 is operatively coupled for indexing the counter 52.

As described further hereinafter, the plug-in counter system 10 is notably useful in controlling the operation of an associated machine such as a duplicating or copy machine and for recording the operation of the associated machine by each of a plurality of authorized operators having respective plug-in counter units 16. Accordingly, the electromagnet 75 is operatively coupled for indexing the counter 52 when the associated machine is activated via the electrical connection made by the electrical connectors 42, 31.

Figure 5:
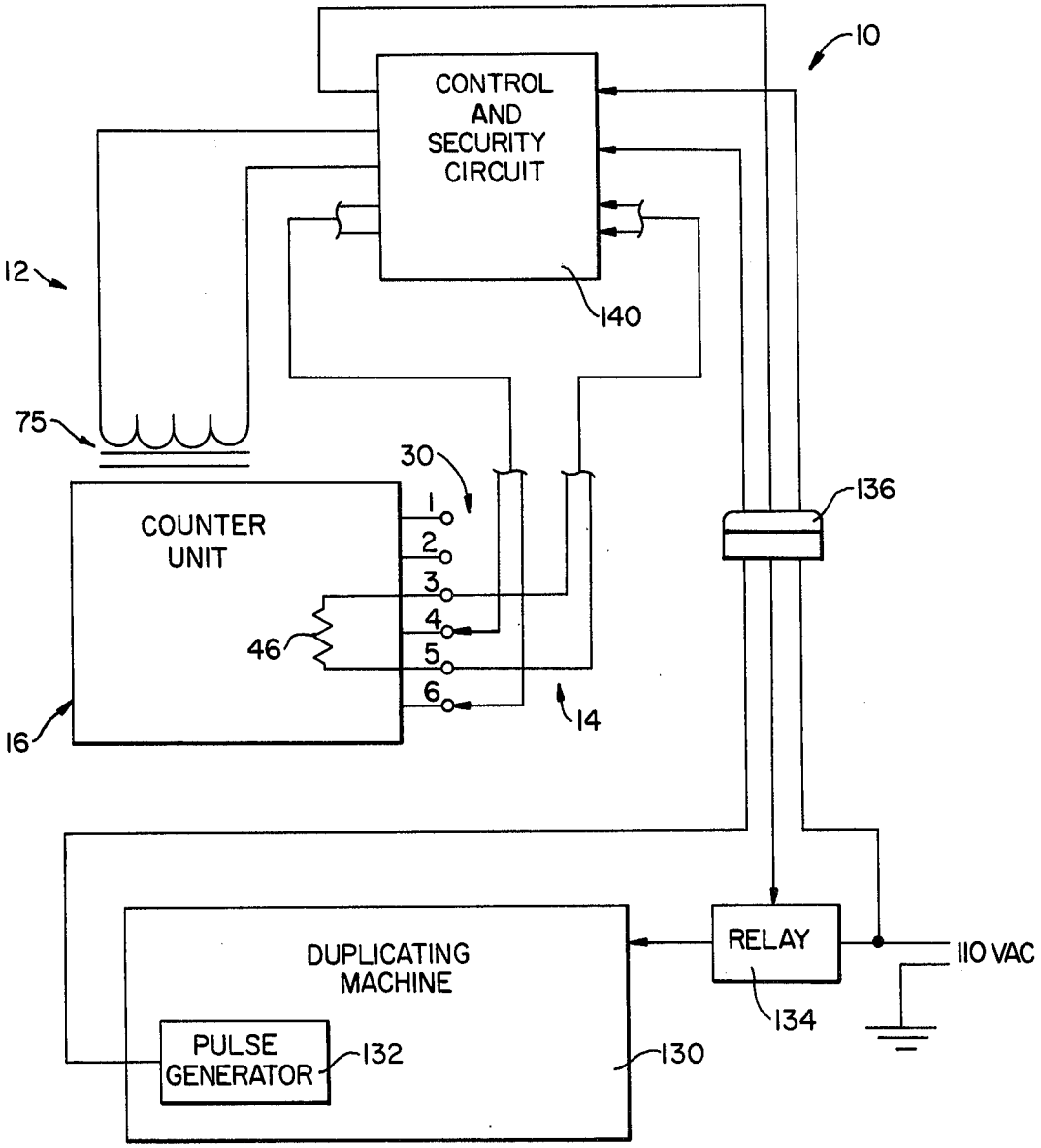
FIG. 5 is a schematic illustration of a plug-in counter and receptacle assembly installed for activating a duplicating machine and recording the number of copies made.

Referring now to FIG. 5, the plug-in counter assembly 10 is schematically shown associated with a duplicating machine 130 of the type having a pulse generator 132 for generating pulses in accordance with the use of the duplicating machine and for example, for generating a pulse for each duplicating cycle of or copy made by the machine. The duplicating machine 130 is adapted to be activated via a relay 134 controlled by the plug-in counter and receptacle assembly 10. The receptacle unit 12 is connected to the duplicating machine pulse generator 132, relay 134 and the machine power source by a suitable connector 136. When a plug-in counter unit 16 is fully inserted into the receptacle 14, the security circuit 46 incorporated in the counter unit 16 is connected (via electrical connectors designated by the numerals 3 and 5) to a suitable control and security circuit 140 of the receptacle unit 12. If the counter unit 16 has the appropriate security circuit 46, the control circuit 140 energizes the relay 134 to activate the duplicating machine 130. The duplicating machine 130 is thereby made operative for making copies, and as copies are made, the pulse generator 132 is operative via the control circuit 140 to energize the electromagnet 75 and index the counter 52 to record the duplicating machine usage.

The control and security circuit 140 is also shown connected to the female receptacle 30 so that a standard plug-in counter unit (not shown) having an internal electromagnet is adapted to be indexed in a conventional manner. Accordingly, it can be seen that the modified receptacle unit 12 can be used with both the improved low-cost counter unit 16 of the present invention as well as standard commercially available counter units (not shown) having internal electromagnets.

It is contemplated that if a complete system redesign were undertaken, modified flux conductors would be employed with a modified external electromagnet, for example, for reducing the magnetic coupling air gap between the electromagnet of the receptacle unit and the flux conductors of the counter unit. And, for example, the flux conductors may be formed to extend rearwardly of the counter unit for direct magnetic coupling with an electromagnet at the rear end of the receptacle unit.

Figure 4:
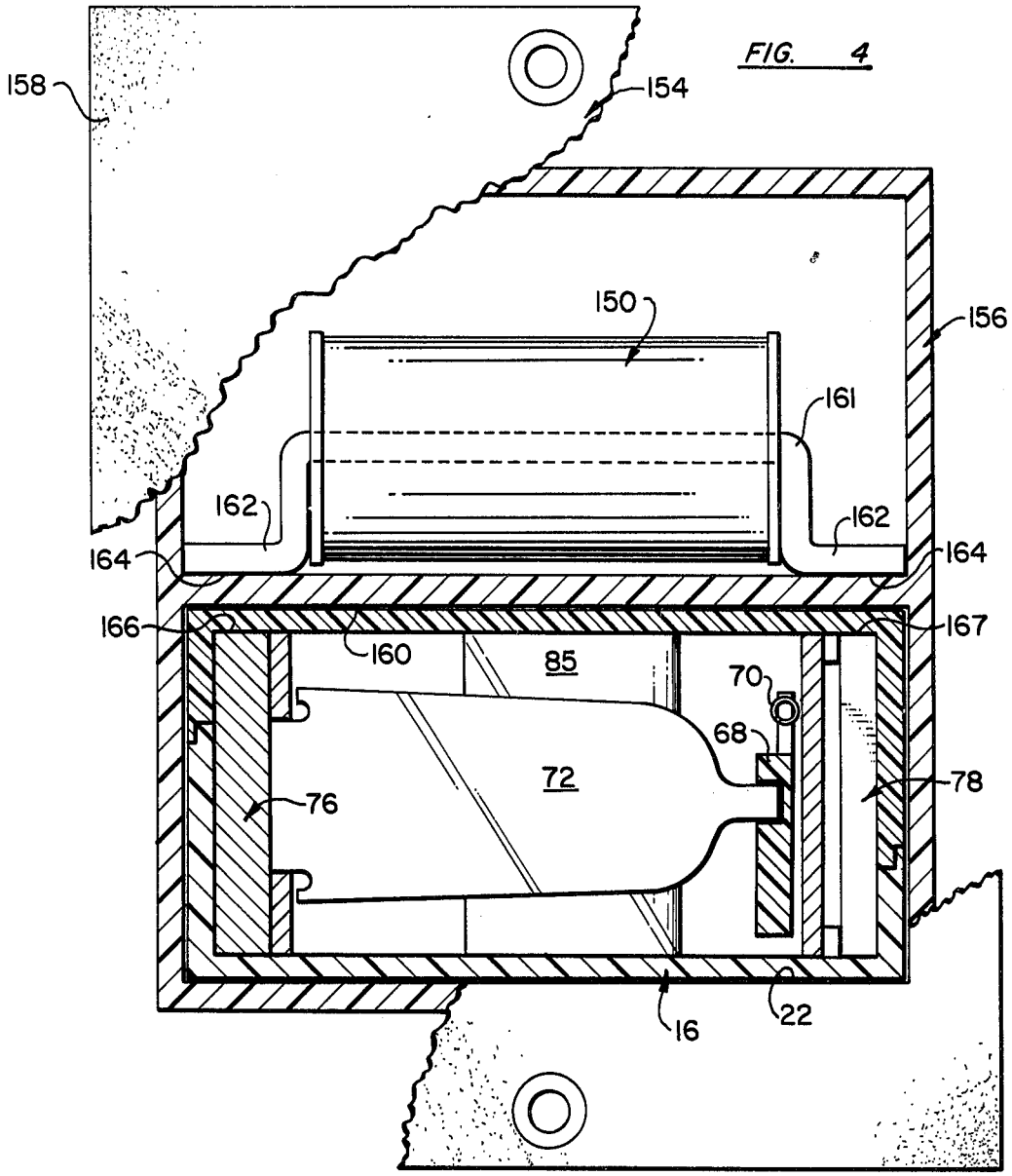
FIG. 4 is a front elevation view, partly broken away and partly in section, of a plug-in counter and receptacle assembly having a modified receptacle.

Also, referring to FIG. 4, a modified electromagnet 150 is shown employed with a different type of conventional molded plastic frame 154 having an upper receptacle 156 behind a front panel 158 of the frame 154 and immediately above a plug-in counter receptacle 160. In this version, the electromagnetic 150 has a core plate 161 with short legs 162 having lower downwardly facing magnetic parallel faces 164 for magnetically coupling the electromagnet 150 to upper edge faces 16, 167 of the flux conductor plates 76, 78 respectively. Thus, in this version, a magnetic coupling is provided between the electromagnet 150 and the flux conductor plates 76, 78 at the upper laterally spaced edges of the plug-in counter unit 16.

As will be apparent to persons skilled in the art, various modifications, adaptations, and variations of the foregoing specific disclosure can be made without departing from the teachings of the present invention.

I claim:

1. In a plug-in counter system for recording the use of an associated business machine by each of a plurality of authorized operators in accordance with usage related signals generated by the machine, the plug-in counter system comprising a plurality of separate plug-in counter units for the plurality of authorized operators respectively, each having a counter and a counter indexing mechanism adapted to be magnetically actuated for indexing the counter, and a plug-in counter receptacle unit having a receptacle for individually receiving the counter units at an operational position therein, the receptacle unit and each counter unit having respective coupling means for operatively coupling a said operationally positioned counter unit to said receptacle unit for activating a said associated business machine and for operatively coupling the receptacle unit to the counter unit for indexing the counter in accordance with the usage related signals generated by the associated business machine, the improvement wherein the coupling means of each counter unit comprises flux conductor means operable when magnetized for magnetically actuating the counter indexing mechanism for indexing the counter, and wherein the coupling means of the receptacle unit comprises an electromagnet having an operating coil adapted to be connected to be energized in accordance with the usage related signals generated by a said business machine, the electromagnet being opratively magnetically coupled to the flux conductor means of a said operationally positioned counter unit for magnetizing the flux conductor means of the counter with the electromaget for indexing the counter.

2. A plug-in counter system according to claim 1 wherein the receptacle has a generally box-like configuration and a generally rectangular front end opening for individually inserting each counter unit to said operational position therein, wherein each counter unit has a box-like case with a generally rectangular transverse cross section generally conforming to the rectangular front end opening of the receptacle for inserting one end of the counter unit therein to position the counter unit at a said operational position within the box-like receptacle, wherein each counter unit indexing mechanism has a pivotal clapper adapted to be magnetically pivotally actuated for indexing the counter, wherein each counter unit flux conductor means has a pair of flux conductors in series magnetic association with the pivotal clapper and having separate outwardly facing magnetic coupling faces internally of but adjacent to the counter unit case, and wherein the electromagnet of the receptacle unit has a pair of end poles with separate inwardly facing magnetic coupling faces externally of but adjacent to the box-like receptacle and opposite to the separate coupling faces of a said operationally positioned counter unit for magnetically coupling the electromagnet thereto.

3. A plug-in counter system according to claim 2, wherein the receptacle unit coupling means comprises an electrical connector at an inner end of the receptacle, and wherein each counter unit coupling means comprises an electrical connector at said one end of the counter unit adapted to make operative electrical connection with the receptacle unit connector, when the counter unit is inserted to a said operational position in the receptacle, after the electromagnet is operatively magnetically coupled to the inserted counter unit, and circuit means connected to the counter unit electrical connector for activating a said business machine with which the receptacle unit is associated.

4. In a plug-in counter system comprising at least one separate plug-in counter unit, each having an outer case and a counter subassembly mounted in the case having a counter frame, and a counter and counter indexing mechanism mounted on the frame, the counter indexing mechanism having a pivotal clapper pivotally mounted on the frame and adapted to be magnetically pivotally actuated for indexing the counter; and a plug-in counter receptacle unit having a receptacle for individually inserting each counter unit to an operational position therein, the receptacle unit and each counter unit having respective coupling means for coupling the receptacle unit to the counter indexing mechanism, when the counter unit is operationally positioned in the receptacle, for indexing the counter, the improvement wherein the coupling means of each counter unit comprises a pair of flux conductors in series magnetic association with the pivotal clapper and operable when magnetized for magnetically pivotally actuating the clapper for indexing the counter, the pair of flux conductors having separate magnetic coupling faces internally of but adjacent to the counter unit case, and wherein the coupling means of the receptacle unit comprises an electromagnet having a pair of end poles with magnetic coupling faces opposite the separate magnetic coupling faces respectively of a counter unit operationally positioned within the receptacle for indexing the counter with the electromagnet.

5. In a plug-in counter system comprising at least one separate plug-in counter unit, each having a counter and a counter indexing mechanism adapted to be magnetically actuated for indexing the counter, and a plug-in counter receptacle unit having a receptacle for individually inserting each counter unit to an operational position therein, the receptacle unit and each counter unit having respective coupling means for coupling the receptacle unit to the counter indexing mechanism, with the counter unit operationally positioned in the receptacle, for indexing the counter, the improvement wherein the coupling means of each counter unit comprises flux conductor means in association with the counter indexing mechanism operable when magnetized for magnetically actuating the counter indexing mechanism for indexing the counter, and wherein the coupling means of the receptacle unit comprises an electromagnet magnetically coupled to the flux conductor means of a said operationally positioned counter unit for magnetizing the flux conductor means with the electromagnet for indexing the counter.

6. A plug-in counter system according to claim 5 for recording the operation of an associated device in accordance with operation signals generated by the device, wherein the receptacle unit comprises control circuit means adapted to be conditioned for activating a said associated device, and wherein the respective coupling means of the counter unit and receptacle are operable for coupling an inserted counter unit to the control circuit means for conditioning the control circuit means for activating a said associated device when the counter unit is inserted to said operational position but after the electromagnet is magnetically coupled to the flux conductor means of the inserted counter unit.

7. A plug-in counter system according to claim 5 wherein the receptacle has a generally box-like configuration and a generally rectangular front end opening for individually inserting each counter unit to an operational position therein, wherein each counter unit has a generally box-like case with a generally rectangular transverse cross section generally conforming to the rectangular front end opening of the receptacle for inserting the counter unit to said operational position therein, wherein each counter unit indexing mechanism has a pivotal clapper adapted to be magnetically pivotally actuated for indexing the counter, wherein each counter unit flux conductor means has a pair of flux conductors in series magnetic association with the pivotal clapper and having separate magnetic coupling faces internally of but adjacent to the counter unit case, and wherein the electromagnet of the receptacle unit has a pair of end poles with respective magnetic coupling faces positioned outwardly of but adjacent to the box-like receptacle to be opposite to the coupling faces respectively of a counter unit operationally positioned within the receptacle for magnetizing the flux conductor means with the electromagnet for indexing the counter.

8. A plug-in counter system according to claim 7 wherein the coupling faces of each counter unit face outwardly in generally opposite directions, and the end pole coupling faces of the electromagnet face inwardly in generally opposite directions.

9. A plug-in counter system according to claim 7 wherein the counter unit magnetic coupling faces are generally parallel and face outwardly in generally the same direction and the end pole magnetic coupling faces of the electromagnet are generally parallel and face inwardly in generally the same direction.

10. A plug-in counter system according to claim 5 wherein each counter unit indexing mechanism comprises a clapper pivotal about one end thereof and mounted to be magnetically pivotally actuated for indexing the counter and wherein each counter unit flux conductor means comprises a pair of separate flux conductors in series magnetic association with the pivotal clapper to be operable when magnetized for magnetically pivotally actuating the clapper for indexing the counter, one of said flux conductors having a clapper actuating pole for magnetically attracting the clapper and the other flux conductor being mounted adjacent said one pivotal end of the clapper to form a flux conductive path thereto.

* * * * *